US007231172B2

(12) United States Patent
Park

(10) Patent No.: US 7,231,172 B2
(45) Date of Patent: Jun. 12, 2007

(54) APPARATUS AND METHOD OF MEASURING PAPER SIZE BY USING SENSOR

(75) Inventor: Yong-whan Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 16 days.

(21) Appl. No.: 10/997,972

(22) Filed: Nov. 29, 2004

(65) Prior Publication Data

US 2005/0232671 A1 Oct. 20, 2005

(30) Foreign Application Priority Data

Apr. 17, 2004 (KR) ..... 10-2004-0026456

(51) Int. Cl.
*G03G 15/00271* (2006.01)

(52) U.S. Cl. ..... 399/389; 271/171

(58) Field of Classification Search ..... 399/389, 399/367; 347/19, 14, 16, 104; 400/708; 271/145–175; 250/559.19, 214; 374/14, 374/16

See application file for complete search history.

(56) References Cited

U.S. PATENT DOCUMENTS 5,130,757 A * 7/1992 Ito ..... 399/14
5,573,236 A * 11/1996 Petocchi et al. ..... 271/265.02

FOREIGN PATENT DOCUMENTS

| | | |
|---|---|---|
| JP | 06-064781 | 3/1994 |
| JP | 6-206342 | 7/1994 |
| JP | 2000-046515 | 2/2000 |
| JP | 2000-063000 | * 2/2000 |
| JP | 2001-322723 | 11/2001 |
| KR | 1999-015658 | 5/1999 |
| KR | 1999-0053934 | 7/1999 |
| KR | 2003-0065077 | 8/2003 |

OTHER PUBLICATIONS

Korean Office Action dated Feb. 14, 2006 issued in 2004-26456.
Office Action issued on Oct. 17, 2005, for Korean Patent Application No. 2004-0026456.

* cited by examiner

*Primary Examiner*—Judy Nguyen
*Assistant Examiner*—Wynn Q. Ha
(74) *Attorney, Agent, or Firm*—Stanzione & Kim, LLP

(57) ABSTRACT

A method of measuring a paper size using a paper feeder having a fixedly mounted body part and a fastener apparatus movable depending on the paper size includes receiving light reflected from the body part with respect to an amount of a sent light, measuring the amount of the received light, and extracting information on a paper size corresponding to the measured amount of light from stored information. The extracted information of the paper size can be transmitted to a display unit, so that a user can recognize the information.

36 Claims, 3 Drawing Sheets

APPARATUS AND METHOD OF MEASURING PAPER SIZE BY USING SENSOR

CROSS-REFERENCE TO RELATED APPLICATIONS

This application claims benefit under 35 U.S.C. § 119 from Korean Patent Application No. 2004-26456 filed on Apr. 17, 2004, the entire content of which is incorporated herein by reference.

BACKGROUND OF THE INVENTION

1. Field of the Invention

The present general inventive concept generally relates to a method of measuring a paper size. More particularly, the present general inventive concept relates to an apparatus and method of measuring each size of sheets of paper loaded in a paper feeder of a body part of an image-forming apparatus.

2. Description of the Related Art

The image-forming apparatus outputs images appearing on monitors, television screens, and other image display devices. FIG. 1 is a view illustrating a paper feeder of an image-forming apparatus. Hereinafter, description will be made on operations between the paper feeder and the sheets of paper loaded in the paper feeder with reference to FIG. 1. The paper feeder includes a body part 100 for accommodating the sheets of paper loaded therein, and a fastener part 102 for fastening and preventing from movement paper loaded in the body portion. That is, the fastener part 102 moves to the left and right depending on a size of paper. The fastener part 102 moves to the right if the size of paper loaded in the body part 100 is narrow, and to the left if the size of paper loaded in the body part 100 is wide.

FIG. 2 is a view illustrating a structure A of the body part 100 of the image-forming apparatus, and FIG. 3 is a view illustrating a structure B of the fastener part 102 of the image-forming apparatus. Hereinafter, description will be made on the structure A of the body part 100 and the structure B of the fastener part 102 of the image-forming apparatus with reference to FIGS. 2 and 3.

The body part of FIG. 2 has first, second, and third contact parts 200, 202, and 204. The respective contact parts 200, 202, and 204 are extended by a certain length. The respective contact parts do not include one projection, but include at least two projections.

The first contact part 200 has the projections in the sections c, e, and f, and the second contact part 202 has the projections in the sections b, d, and f. The third contact part 204 has the projections in the sections a, d, and e. In other words, the section a has a readout of the third contact part 204, and the section b has the projection of the second contact part 202. The section c has the projection of the first contact part 200, and the section d has the projection of the second contact part 202 and the projection of the third contact part 204. The section e has the projection of the first contact part 200 and the projection of the third contact part 204, and the section f has the projection of the first contact part 200 and the projection of the second contact part 202. As described above, the image-forming apparatus has the projections different from section to section.

In FIG. 3 illustrating the structure B of the fastener part 102 of the image-forming apparatus, the fastener part 102 has the same number of sensors as the number of contact parts constituting the body part 100. Since FIG. 2 has three contact parts, the fastener part 102 also has three sensors. An interval between the sensors is equal to an interval between the contact parts. That is, the first sensor 300 contacts the first contact part 200, the second sensor 302 contacts the second contact part 202, and the third sensor 304 contacts the third contact part 204.

Hereinafter, description will be made on the measurement of the size of the paper loaded in the paper feeder using the projections of the body part and the sensors moving together with the faster part 102. As described above, the fastener part 102 is movable with respect to the body part 100, that is, can be adjusted depending on the size of the paper. If the sensors are positioned in the section a, the third sensor 304 detects the projection of the third contact part 204. If the sensors are positioned in the section b, the second sensor 302 detects the projection of the second contact part 202. If the sensors are positioned in the section c, the first sensor 300 detects the projection of the first contact part 200. If the sensors are positioned in the section d, the second sensor 302 detects the projection of the second contact part 202, and the third sensor 304 detects the projection of the third contact part 204. If the sensors are positioned in the section e, the first and third sensors 300 and 304 detect the projections of the first and third contact parts 200 and 204, respectively. If the sensors are positioned in the section f, the first sensor 300 detects the projection of the first contact part 200, and the second sensor 302 detects the projection of the second contact part 202.

The image-forming apparatus stores information on the number of detected projection(s) and the size of the paper depending upon their positions. Thus, the image-forming apparatus can recognize the size of the paper loaded in the paper feeder using a detection signal sent from the sensor(s).

However, the measurement of the paper size by a combination of the sensors causes a problem in that such measurement increases a volume of the body part and the fastener part for such detections. When the projections are damaged or a function of the projections deteriorates due to a temperature or a long-time use, it is impossible to perform precise detection through the damaged projections.

SUMMARY OF THE INVENTION

In order to solve the above and/or other problems, it is an aspect of the present general inventive concept to provide an apparatus and method capable of reducing a volume of a detecting unit to measure a paper size.

It is another aspect of the present general inventive concept to provide an apparatus and method capable of precisely detecting a paper size without being influenced from ambient environment.

It is yet another aspect of the present general inventive concept to provide an apparatus and method capable of rapidly measuring a paper size loaded in a paper feeder upon users' request.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept may be achieved by providing a method of measuring a paper size by a fastener part of a paper feeder, the paper feeder having a fixedly mounted body part, and the fastener part movable depending on the paper size, the method comprising receiving light reflected from the body part out of a sent amount of light to measure the received amount of light, extracting from stored information on a paper size corresponding to the measured amount of light, and delivering the extracted information on the paper size.

In an aspect of the present general inventive concept, the extracting of the information may comprise obtaining a ratio of the received amount of light to the sent amount of light, and extracting from the stored information the information of the paper size corresponding to the ratio, or extracts extracting from the stored information the information of the paper size using only the received amount of light if a certain amount of light is received.

In another aspect of the present general inventive concept, the body part may be step-shaped to have different reflection amounts on the sent light so that paper sizes of loaded paper can be distinguished from each other, or the body part may have a predetermined slope to have different reflection amounts on the sent light depending on kinds of the loaded paper.

In yet another aspect of the present general inventive concept, a predetermined amount of light can be repeatedly sent as the sent light in a predetermined time interval so that errors on paper size measurements can be reduced.

In still another aspect of the present general inventive concept, the received amount of light can be converted into a voltage or current, and the paper size corresponding to a magnitude of the converted voltage or current can be extracted.

The foregoing and/or other aspects and advantages of the present general inventive concept may also be achieved by providing a paper feeder used with an image-forming apparatus to measure a paper size, the paper feeder having a fixedly mounted body part and a fastener part movable depending on a size of paper loaded in the body part, the paper feeder comprising a light-sending unit, a light-receiving unit to receive light reflected from the body part out of an amount of light sent by the light-sending unit, a measurement unit to measure the amount of light received by the light-receiving unit, and a control unit to extract information of a paper size corresponding to the measured amount of light from stored information containing a relationship between the paper size and the measured amount of the light, and to output the extracted information on the paper size to a display unit.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
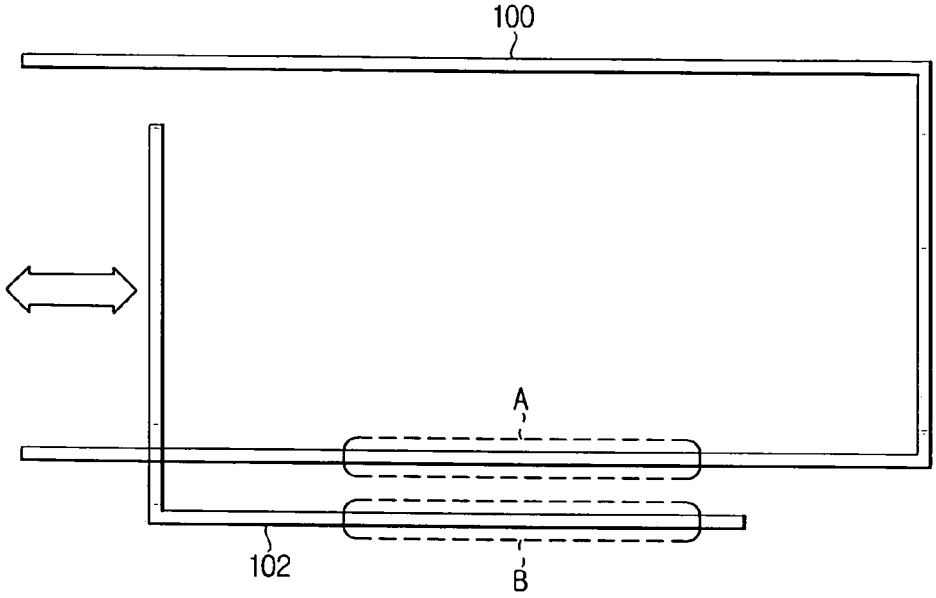
FIG. 1 (PRIOR ART)
FIG. 1 is a view illustrating a structure of a paper feeder of a conventional image-forming apparatus.
Figure 2:
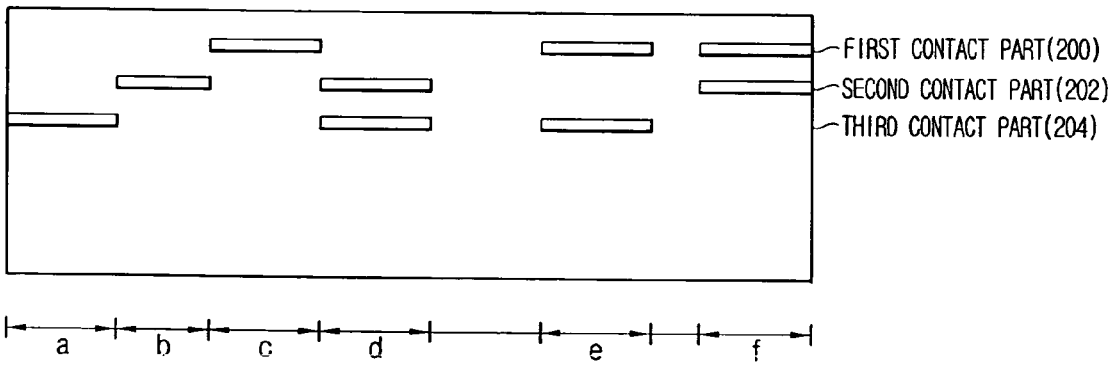
FIG. 2 (PRIOR ART)
FIG. 2 is a view illustrating a structure of a body part of the paper feeder of FIG. 1.
Figure 3:
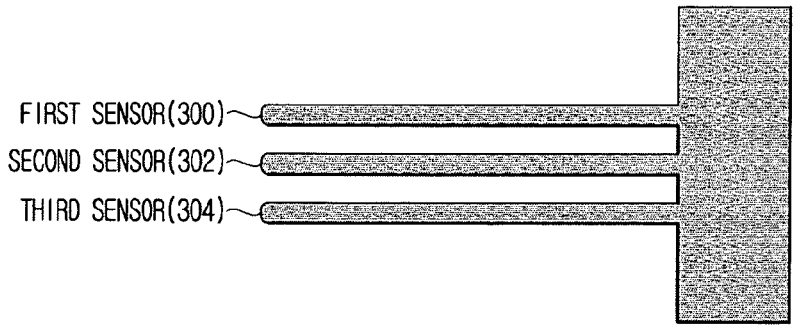
FIG. 3 is a view illustrating a structure of a fastener part of the paper feeder of FIG. 1.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 4:
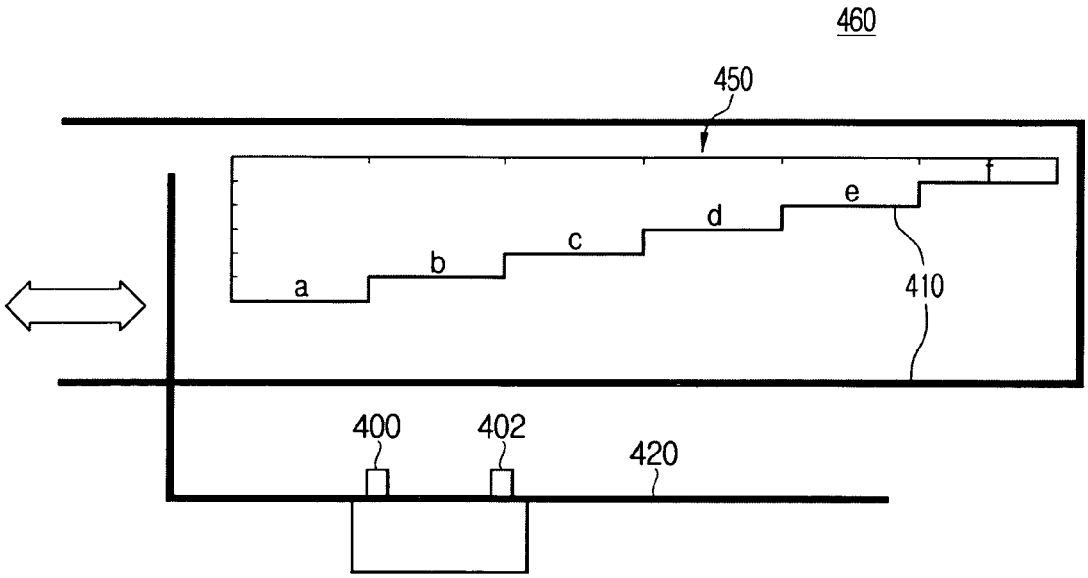
FIG. 4 is a view illustrating a structure of a paper feeder according to an embodiment of the present general inventive concept.

FIG. 4 is a view illustrating a body part 410 and a fastener part 420 of a paper feeder 450 of an image-forming apparatus 460 according to an embodiment of the present general inventive concept. Hereinafter, description will be made in detail on the body part 410 and the fastener part 420 of the paper feeder 450 with reference to FIG. 4. The body part 410 can be formed in a shape of steps including sections a to f. As described above, the fastener part 420 can be movable with respect to the body part 410 and can include a light-sending unit 400 and a light-receiving unit 402. The light-sending unit 400 can send a certain amount of light toward the steps or one of the steps according to a control signal of a controller (not shown) after the fastener part 420 is moved according to the paper loaded on the body part 410, and the light-receiving unit 402 can receive light reflected from the body part 410 with respect to the light sent from the light-sending unit 400. The light-sending unit 400 can send the light in a certain direction only. In general, the light-sending unit 400 can send light in all directions toward the body part 410. FIG. 4 illustrates the body part 410 formed in a step shape, but the body part 410 is not limited to this shape. That is, the body part 410 can be formed in a ramp shape to have a certain angle with the fastener part 420. Table 1 shows the amounts of light received by the light-receiving unit 402 depending on distances between the body part 410 and the fastener part 420.

TABLE 1

| Sections | Received light amount/sent light amount (%) |
|---|---|
| Section a | 90 |
| Section b | 80 |
| Section c | 70 |
| Section d | 60 |
| Section e | 50 |
| Section f | 40 |

The received amount of light from each section with respect to the sent amount of light may vary depending upon a distance between each section of the body part 410 and the fastener part 420. Thus, a user can set the image-forming apparatus to have a different distance between respective sections of the body part 410 and the fastener part 420. Accordingly, the received amount of light with respect to the sent amount of light may vary depending on the different distance set by the user. The body part 410 of FIG. 4 has six sections, but the number of sections can be adjusted corresponding to the kinds of paper to be measured.

Figure 5:
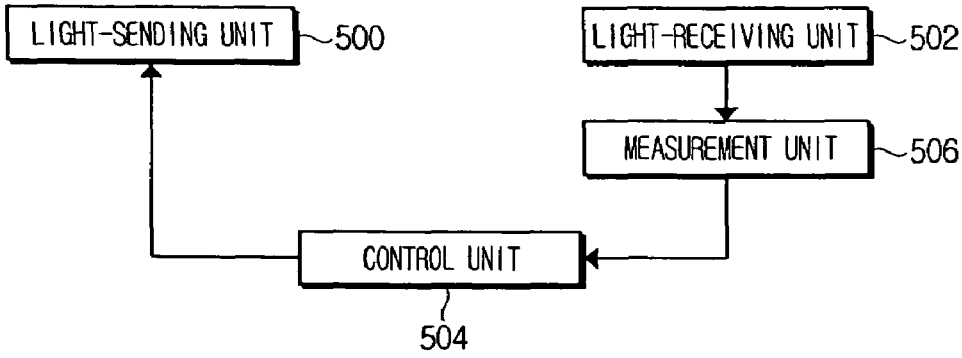
FIG. 5 is a block diagram illustrating a paper feeder of an image-forming apparatus according to an another embodiment of the present general inventive concept.

FIG. 5 is a block diagram illustrating a paper feeder of an image-forming apparatus according to another embodiment of the present general inventive concept. Referring to FIGS. 4 and 5, the paper feeder may include a light-sending unit 500, a light-receiving unit 502, a control unit 504, and a measurement unit 506. The light-sending unit 500 and light-receiving unit 502 can be constituted in one body, and the control unit 504 and the measurement unit 506 can be also constituted in one body.

The light-sending unit 500 can send a certain amount of light toward the body part 410 according to a control signal sent from the control unit 504. The light-receiving unit 502 can receive light reflected from the body part 410 with respect to the light sent by the light-sending unit 500. The light-receiving unit 502 can send a signal corresponding to an amount of the received light to the measurement unit 506. The measurement unit 506 can measure the amount of light sent by the light-receiving unit 502 according to the signal, and can send information on the measured light amount to the control unit 504.

The control unit 504 can control the light-sending unit 500 to send a predetermined light amount. For a precise measurement, the control unit 504 can control the light-sending unit 500 to send the predetermined light amount at least twice in a predetermined time interval. The control unit 504 can measure a ratio of the amount of light sent by the light-sending unit 500 with respect to the amount of light received by the light-receiving unit 502 using the amount of light received from the measurement unit 506 and the amount of light received from the light-sending unit 500. If the control unit 504 controls the light-sending unit 500 to send the predetermined light amount at least twice, the predetermined time period in which light is subsequently sent can be set to be a time period during which the previously sent light has been received by the light-receiving unit 502.

The control unit 504 can extract information on a size of paper loaded in the paper feeder using the ratio of the measured amount of light with respect to the sent amount. Table 2 shows light amount ratios and kinds of paper that are stored in the control unit 504, for example.

TABLE 2

| Received light amount/sent light amount (%) | Kinds of paper |
|---|---|
| 88 to 92 | Legal |
| 78 to 82 | Folio |
| 68 to 72 | A4 |
| 58 to 62 | Letter |
| 48 to 52 | B5 |
| 38 to 42 | A5 |

The control unit 504 can send the extracted information to a display unit (not shown) so that a user can recognize the paper size. The control unit 504 may have certain ranges of the light amount ratios that are considered due to errors on the amounts of light received and sent. The ranges can be adjusted according to a user preference.

If the control unit 504 controls the light-sending unit 500 to send a certain amount of light, the kinds of paper can be measured using the received amount of light. That is, if the control unit 504 controls the light-sending unit 500 to send a light amount of 100, the information of the kind of paper can be extracted according to the received light amount. Table 3 as below shows the kinds of paper to the received light amounts, for example.

TABLE 3

| Received amounts of light | Kinds of paper |
|---|---|
| 88 to 92 | Legal |
| 78 to 82 | Folio |
| 68 to 72 | A4 |
| 58 to 62 | Letter |
| 48 to 52 | B5 |
| 38 to 42 | A5 |

Figure 6:
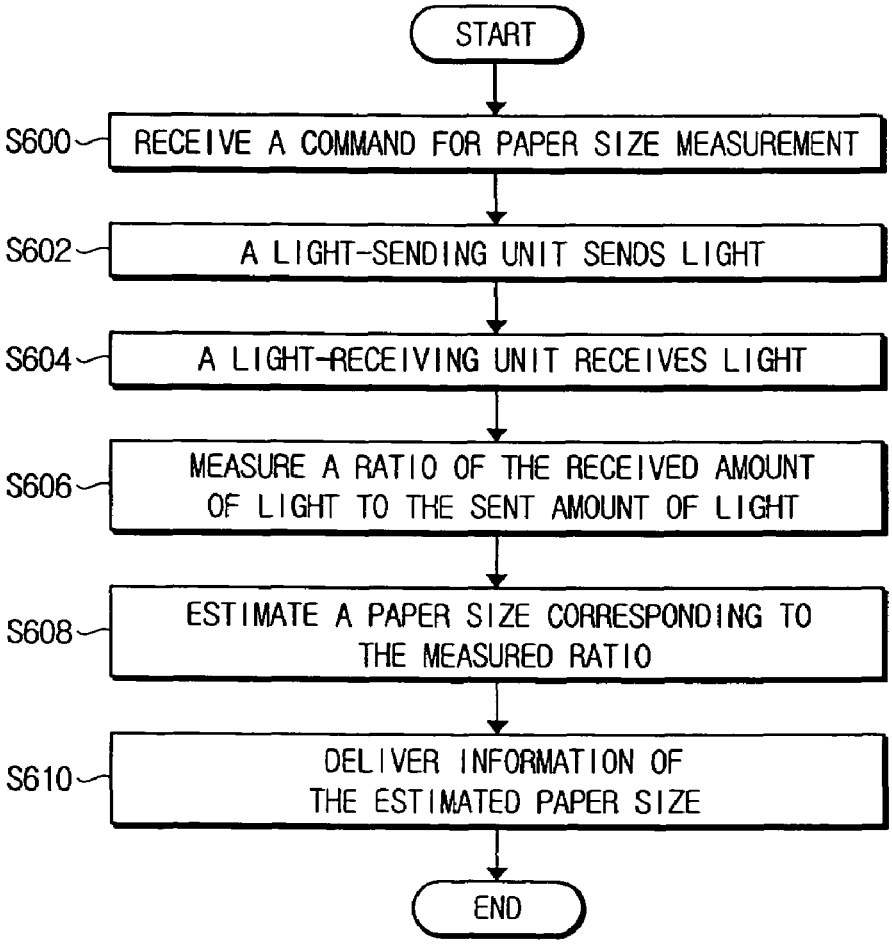
FIG. 6 is a flowchart illustrating a method of a paper feeder according to another embodiment of the present general inventive concept.

FIG. 6 is a flow chart illustrating a method of a paper feeder according to another embodiment of the present general inventive concept. Hereinafter, description will be made in detail on operations of the method of the paper feeder with reference to FIGS. 5 and 6.

The control unit 504 can receive a command (command signal) from an external device (not shown) or the paper feeder to measure of a size of paper loaded in the paper feeder when the paper is loaded in the paper feeder, in operation S600. Even though the control unit 504 does not receive the command signal for the paper size measurement, the control unit 504 can measure the size of paper in a predetermined time interval. The control unit 504, upon receiving the command signal for the paper size measurement, can control the light-sending unit 500 to send a certain amount of light. The control unit 504 can control the light-sending unit 500 to send light together with information of an amount of light to be sent. Furthermore, the control unit 504 can control the light-sending unit 500 to send light without information of an amount of light.

The light-sending unit 500 can send the light in operation S602. If the light-sending unit 500 receives the command signal from the control unit 504 to send light together with information of an amount of light, the light-sending unit 500 can send the amount of light according to the command signal. If the control unit 504 controls the light-sending unit 500 to send the light without information of a light amount, the light-sending unit 500 can send a predetermined amount of light.

The light-receiving unit 502 can receive the light reflected from the body part in operation S604. The light-receiving unit 502 can transmit a signal representing an amount of the received light to the measurement unit 506. The measurement unit 506 can measure the amount of the received light using the signal and can send the information on the measured light amount to the control unit 504.

The control unit 504 can measure a ratio of the sent light amount with respect to the received light amount using the information on the light amount received from the measurement unit 506 in operation S606. The control unit 504 can estimate the size of paper loaded in the paper feeder based on the measured ratio in operation S608. If the light-sending unit 500 sends a certain amount of light, the control unit 504 can estimate the size of paper loaded in the paper feeder using only the received amount of light. The control unit 504 can transmit the information on the estimated paper size to the display unit so that a user can recognize the information in operation S610.

As described above, the control unit 504 can measure the paper size using the received amount of light. However, the received amount of light can be converted into an electrical current or voltage, and then the control unit 504 can estimate the paper size by measuring an amount of the converted current or voltage. Table 4 as below shows the kinds of paper to currents converted from the received amount of light, for example.

TABLE 4

| Converted currents | Kinds of paper |
|---|---|
| 20.8 to 21.2 | Legal |
| 18.8 to 19.2 | Folio |
| 16.8 to 17.2 | A4 |
| 14.8 to 15.2 | Letter |
| 12.8 to 13.2 | B5 |
| 10.8 to 11.2 | A5 |

As described above, the image-forming apparatus can measure an amount of light reflected from the body part out of the light sent by the light-sending unit 500 so as to measure the size of paper loaded in the paper feeder. By adopting the above manner, the present general inventive concept can reduce the volume of units to measure the size of paper loaded in the paper feeder as well as reduce measurement errors occurring due to uses of the paper feeder for a long time. If a user wishes to know the size of paper loaded in the paper feeder, the user can promptly recognize the size of paper loaded in the paper feeder.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A method of measuring a paper size in a paper feeder having a fixedly mounted body part and a fastener apparatus movable depending on the paper size, the method comprising:

receiving light reflected from a side portion of the body part having a plurality of sections at a corresponding plurality of distances from the fastener apparatus with respect to a sent amount of light; and determining a paper size corresponding to the received amount of the light.

2. The method of claim 1, wherein the sent amount of light is sent toward the side portion of the body part in a first direction, and the receiving of the light reflected from the side portion of the body part comprises receiving the reflected light in a second direction opposite to the first direction.

3. The method of claim 1, wherein the determining of the paper size comprises:

generating a ratio of the received amount of the light received from the side portion of the body part to the sent amount of the light, and extracting from stored information the paper size corresponding to the ratio.

4. The method of claim 1, wherein the determining of the paper size comprises:

extracting from stored information the paper size using only the received amount of the light received from the side portion of the body part if the received amount of the light is greater than a reference amount.

5. The method of claim 1, wherein the side portion of the body part is step-shaped to have different reflection amounts reflected from the plurality of sections with respect to the sent light so that the paper size of the loaded paper can be determined according to the different reflection amounts.

6. The method of claim 1, wherein the side portion of the body part is sloped at a predetermined slope to have different reflection amounts reflected from the Diurality of sections with respect to the sent light depending on kinds of paper loaded in the body part, so that a fastener apparatus receives at least one of the different reflection amounts as the received amount.

7. The method of claim 1, wherein determining of the paper size comprises:

converting the received amount of the light into a voltage or current; and extracting the paper size corresponding to a magnitude of the converted voltage or current.

8. The method of claim 1, wherein the sent amount of the light is repeatedly sent in a predetermined interval, and the receiving of the light reflected from the side portion of the body part comprises repeatedly receiving the received amount of the light with respect to the respectively sent light, so that errors on paper size measurements can be reduced.

9. The method of claim 1, wherein the received amount of the light from the side portion of the body oart represents a distance between the body part and a fastener apparatus receiving the light, and the determining of the paper size comprises determining the paper size according to the distance.

10. The method of claim 1, wherein the determining of the paper size comprises:

extracting information on one of the paper sizes as the determined paper size from stored information containing relationships between different amounts of the light and the respective paper sizes, according to the received amount of the light received from the side portion of the body part.

11. The method of claim 1, wherein the determining of the paper size comprises:

measuring the received amount of the light received from the side portion of the body part; and extracting information on one of the paper sizes as the determined paper size from stored information containing relationships between different amounts of the light and the respective paper sizes, according to the measured amount of the light.

12. The method of claim 11, further comprising:

outputting the extracted information on the paper size to a display unit.

13. A paper feeder to measure a paper size, comprising:

a fastener apparatus movable depending on the paper size of paper contained in, the paper feeder;

a body part to contain the paper in the paper feeder, the body part comprising a side portion facing the fastener apparatus and having a plurality of sections at a corresponding plurality of distances from the fastener apparatus;

a light-sending unit to output light towards the side portion of the body part;

a light-receiving unit to receive light reflected from the side portion of the body part with respect to an amount of light sent by the light-sending unit; and a control unit to determine a paper size corresponding to the received amount of light.

14. The paper feeder of claim 13, wherein:

the light-sending unit outputs the light toward the side portion of the body part in a first direction; and the light-receiving unit receives the light reflected from the side portion of the body part in a second direction opposite to the first direction.

15. The paper feeder of claim 13, wherein the control unit stores information on the paper size corresponding to the received amount of light received from the side portion of the body part if the received amount of the light is greater than a reference amount.

16. The paper feeder of claim 13, wherein the control unit stores information on the paper size corresponding to a ratio of the received amount of light to the sent amount of light.

17. The paper feeder of claim 13, wherein the side portion of the body part is step-shaped to have different reflection amounts reflected from the plurality of sections with respect to the sent light, and the light-receiving unit receives one of the different reflection amounts as the received amount so that the paper size of loaded paper can be determined.

18. The paper feeder of claim 13, wherein the side portion of the body part is sloped at a predetermined slope to have different reflection amounts reflected from the plurality of sections with respect to the sent light depending on kinds of loaded paper in the body part, so that the fastener apparatus having the light-sending unit and the light-receiving unit receives at least one of the different reflection amounts as the received amount.

19. The paper feeder of claim 13, wherein the control unit repeatedly sends the sent amount of the light towards the side portion of the body part in a predetermined interval, and the control unit repeatedly receives the received amount of the light received from the side portion of the body part with respect to the respectively sent light, so that an error on paper size measurements can be reduced.

20. The paper feeder of claim 13, wherein the control unit converts the received amount of light into a voltage or current, and extracts the paper size corresponding to a magnitude of the converted voltage or current.

21. The paper feeder of claim 13, wherein the received amount of the light received from the side portion of the body part represents a distance between the body part and the fastener apparatus having the light-receiving part, and the control unit determines the paper size according to the distance.

22. The paper feeder of claim 13, wherein the control unit extracts information on one of the paper sizes as the determined paper size from stored information containing relationships between different amounts of the light and the respective paper sizes, according to the received amount of the light received from the side portion of the body part.

23. The paper feeder of claim 13, further comprising:

a measurement unit to measure the amount of the light received by the light-receiving unit from the side Dortion of the body part, wherein the control unit extracts information on the paper size according to the amount of the light from stored information containing a relationship between the paper size and the measured amount of the light.

24. A paper feeder used with an image-forming apparatus, comprising:

a body part to receive one of a first paper having a first size and a second paper having a second size, and having a side portion having a plurality of sections; and a fastener apparatus to move with respect to the body part according to the received one of the first paper and the second paper, and to receive one of a first light reflected from the side portion of the body part when the first paper is disposed in the body part, and a second light reflected from the side portion of the body part when the second paper is disposed in the body part; and a control unit to determine one of the first size and the second size according to one of a first amount of the first light and a second amount of the second light, wherein the side portion faces the fastener apparatus and the plurality of sections are at a corresponding plurality of distances from the fastener apparatus.

25. The paper feeder of claim 24, wherein the fastener apparatus comprises:

a light-sending portion to send light toward the side portion of the body part in a first direction; and a light-receiving portion to receive one of the first reflected light and the second reflected light reflected from the side portion of the body part in a second direction opposite to the first direction.

26. The paper feeder of claim 24, wherein the plurality of sections are formed in a body.

27. The paper feeder of claim 24, wherein the plurality of sections has different areas in a light emitting direction of the first light.

28. The paper feeder of claim 24, wherein the plurality of sections of the side ortion of the body part comprises:

a first step section spaced apart from the fastener apparatus by a first distance; and a second step section spaced apart from the fastener apparatus by a second distance, wherein the first amount of the first light and the second amount of the second light represent the first distance and the second distance, respectively.

29. The paper feeder of claim 28, wherein the control unit determines the one of the first size and the second size according to the first distance and the second distance.

30. The paper feeder of claim 24, wherein the fastener apparatus comprises:

a light-sending unit to send light toward the side portion of the body part; and a light-receiving unit to receive the one of the first light and the second light reflected from the side portion of the body qart in response to the light sent from the light-sending unit.

31. The paper feeder of claim 30, wherein the light-sending unit sends the light at least two times in a predetermined interval, and the light-receiving unit receives the one of the first light and the second light sent at least two times in the predetermined interval.

32. The paper feeder of claim 31, wherein the control unit determines the one of the first size and the second size according to the at least two-times received one of the first light and the second light.

33. The paper feeder of claim 24, wherein the control unit comprises:

stored information containing relationships between the first amount of the first light and the first size and between the second amount of the second light and the second size, wherein the control unit extracts information on the determined one of the first size and the second size paper size according to the one of the first and second amounts from the stored information.

34. The paper feeder of claim 24, wherein the piurality of sections of the side portion of the body part comprises:

a first side section having a first distance from the fastener apparatus to reflect the first light; and a second side section having a first distance from the fastener apparatus to reflect the second light.

35. The paper feeder of claim 24, wherein the first amount of the first light is not the same as the second amount of the second light.

36. The paper feeder of claim 24, wherein the first amount of the first light and the second amount of the second light represent a first distance and a second distance between different sections of the plurality of sections of the side portion of the body part and the fastener apparatus according to a kind of the first paper and the second paper.

* * * * *